United States Patent [19]

Yasuda

[11] 4,442,344

[45] Apr. 10, 1984

[54] SENSOR CONTROLLED COOKING APPARATUS

[75] Inventor: Takatoshi Yasuda, Yamatokoriyama, Japan

[73] Assignee: Sharp Kabushiki Kaisha, Osaka, Japan

[21] Appl. No.: 285,506

[22] Filed: Jul. 21, 1981

[30] Foreign Application Priority Data

Jul. 28, 1980 [JP] Japan ..... 55-107178[U]

[51] Int. Cl.[3] ..... H05B 1/02

[52] U.S. Cl. ..... 219/497; 219/501; 219/505; 324/105

[58] Field of Search ..... 219/492, 490, 10.55 B, 219/506, 494, 497, 507, 505, 501; 426/243; 340/632-634; 324/105, 62

[56] References Cited

U.S. PATENT DOCUMENTS 4,097,723 6/1978 Leitner et al. ..... 219/494

4,311,895 1/1982 Tanabe ..... 219/497

4,320,285 3/1982 Koether ..... 219/497

*Primary Examiner*—M. H. Paschall

*Attorney, Agent, or Firm*—Birch, Stewart, Kolasch & Birch

[57] ABSTRACT

A microwave oven includes a gas sensor for detecting a cooking condition. The resistance value of the gas sensor varies in response to the concentration of the gas generated from the foodstuff being cooked in the microwave oven. A resistance-to-frequency converter including an astable multivibrator is provided for converting the variation of the resistance value of the gas sensor into a frequency signal. A cooking constant setting circuit is provided for developing a signal of a reference frequency in response to a menu to be conducted. The frequency signal, indicative of the resistance value of the gas sensor, obtained by the resistance-to-frequency converter is compared with the reference frequency to terminate the cooking operation when the frequency signal reaches the reference frequency.

12 Claims, 5 Drawing Figures

SENSOR CONTROLLED COOKING APPARATUS

BACKGROUND AND SUMMARY OF THE INVENTION

The present invention relates to a cooking apparatus and, more particularly, to a control system for controlling a cooking operation in response to a sensor output.

Various sensors have been developed to automatically control the cooking operation. A typical control system employing a gas sensor for detecting the cooking completion is disclosed in U.S. Pat. No. 4,311,895 issued on Jan. 19, 1982 and entitled COOKING UTENSIL CONTROLLED BY GAS SENSOR OUTPUT by Takeshi Tanabe, assigned to the same assignee as the present application. The Specification of the issued patent is hereby incorporated by reference. (The British counterpart is Application No. 7930612 filed on Sept. 4, 1979; the German counterpart is P29 35 862.1 filed on Sept. 5, 1979; and Canadian counterpart is Ser. No. 334,838 filed on Aug. 31, 1979. )

In the conventional system, the cooking condition is detected by converting the sensor resistance variation into a voltage signal. More specifically, in the conventional system, the initial voltage level $V_0$ is first obtained. A detection voltage $V_1$ obtained during the cooking operation is compared with the initial voltage level $V_0$. When the voltage level ratio $V_1/V_0$ reaches a preselected value, the control system determines that the cooking operation has been conducted to a desired level and functions to terminate the cooking operation.

In the resistance-to-voltage converting system, the characteristic resistance of the sensor element greatly influences the detection accuracy. Thus, a compensation circuit is required, which complicates the cooking operation control system.

Accordingly, an object of the present invention is to provide a cooking operation control system responsive to a sensor output.

Another object of the present invention is to provide a cooking condition detection circuit responsive to a gas sensor output signal.

Still another object of the present invention is to provide a cooking condition detection system for ensuring an accurate detection operation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, the variation of the sensor resistance is converted into a variation of the frequency of a detection signal. By monitoring the detection signal frequency, the detection accuracy is greatly enhanced because the ratio between the initial frequency and the detection frequency is not dependent on the characteristic resistance of the sensor element.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
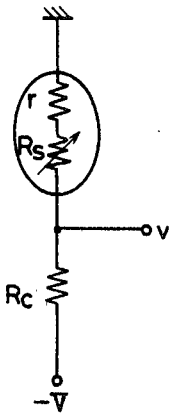
FIG.1 PRIOR ART
FIG. 1 is a schematic circuit diagram showing a basic construction of the cooking condition detection circuit of prior design.

In the conventional cooking condition detection system, the variation of the sensor resistance is converted into a variation of the voltage level through the use of a circuit as shown in FIG. 1. In FIG. 1, $R_s$ represents the sensor element resistance which varies in response to the gasses contacting the sensor element, r represents the characteristic resistance of the sensor element, $R_c$ represents a reference resistance, V represents a reference voltage, and v represents an output voltage. In the conventional detection circuit, the output voltage v is greatly influenced by the undesirable variation of the characteristic resistance r of the sensor element. Further, the detection ratio $V_1/V_0$ is greatly influenced by the distribution of the characteristic resistance r. Therefore, to ensure accurate detection, a compensation resistor is required to compensate for the distribution of the characteristic resistance r of the sensor element. This requirement complicates the circuit construction. The present invention solves the above-mentioned problems. The present invention provides a cooking condition detection system, wherein the variation of the sensor resistance is converted into the variation of the frequency of a detection signal.

Figure 2:
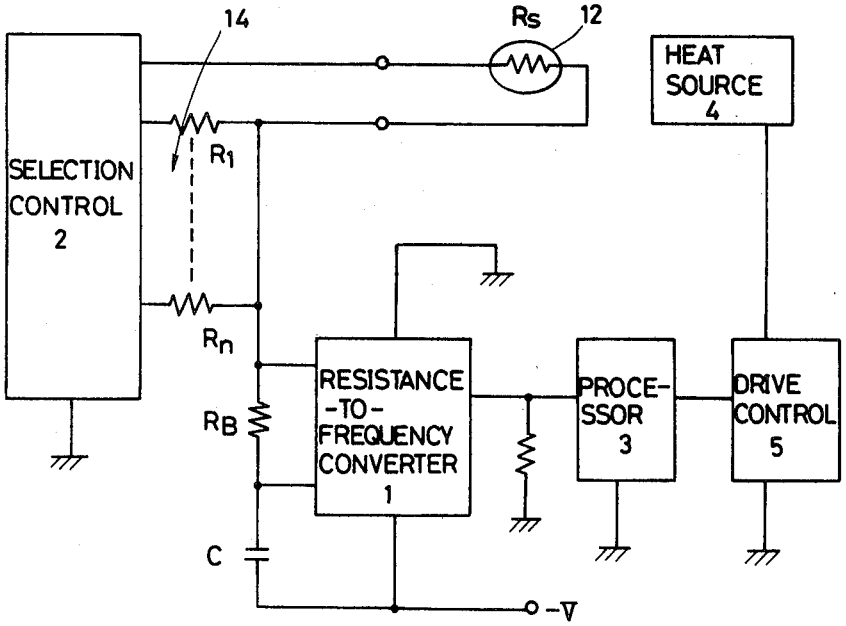
FIG. 2 is a schematic block diagram of an embodiment of a cooking operation control system of the present invention.

FIG. 2 shows an embodiment of a cooking operation control system of the present invention, which is employed in a microwave oven having a gas sensor for detecting a cooking condition.

The cooking operation control system of the present invention comprises a resistance-to-frequency converter 1 implemented with an astable multivibrator. A charge/discharge circuit including a resistor $R_B$ and a capacitor C is connected to the resistance-to-frequency converter 1 for determining an oscillation frequency of the resistance-to-frequency converter 1. A selection control circuit 2 is provided for determining a cooking constant in response to the kind of foodstuff to be cooked. A resistor group 14 includes a plurarity of resistors $R_1$ through $R_n$ which are connected to the resistor $R_B$, together with and a gas sensor 12 are connected to the selection control circuit 2. The selection control circuit 2 functions to select a predetermined resistor from the resistor group 14 in response to the selection operation conducted through a keyboard panel (not shown), thereby connecting the predetermined resistor to the charge/discharge circuit in response to the kind of foodstuff to be cooked.

The selection control circuit 2 can be implemented with a microcomputer μPD-550C manufactured by Nippon Electric Co., Ltd. A preferred gas sensor is TGS#813 manufactured by Figaro Engineering Inc., which is discussed in the U.S. Pat. No. 4,311,895 entitled, COOKING UTENSIL CONTROLLED BY GAS SENSOR OUTPUT.

The cooking operation control system of the present invention further comprises a processor 3 connected to receive an output signal from the resistance-to-frequency converter 1. The processor 3 includes a CPU, a ROM and a RAM incorporated into a one chip microcomputer. A preferred processor 3 is μPD-1514C manufactured by Nippon Electric Co., Ltd. The processor 3 functions to count the number of pulses within a preselected period of the output signal derived from the resistance-to-frequency converter 1 for detecting the oscillation frequency of the resistance-to-frequency converter 1.

Through the use of the thus obtained frequency information, the processor 3 functions to compare the frequency derived from the gas sensor output with the cooking constant determined through the use of the selection control circuit 2. The processor 3 functions to develop a control signal to terminate the cooking operation when the processor 3 determines that the cooking operation is conducted to a desired level. The control signal developed from the processor 3 is applied to a drive control circuit 5 for terminating the operation of a cooking heat source 4, for example, a magnetron in response to the control signal derived from the processor 3.

Figure 4:
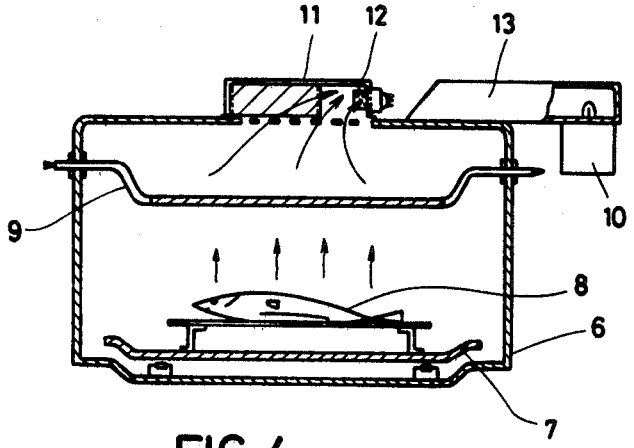
FIG. 4 is a sectional view of a microwave oven employing the cooking operation control system of FIG. 2.

FIG. 4 shows a microwave oven employing the cooking operation control system of FIG. 2. The microwave oven includes an oven cavity 6. A turntable 7 is disposed at the lower section of the oven cavity 6 for supporting a foodstuff 8 to be cooked. A sheath heater 9 is disposed at the upper section of the oven cavity 6 for performing the electric heating cooking operation. A magnetron 10 is provided for conducting the microwave cooking operation. Microwave energy (2,450 MHz) generated from the magnetron 10 is introduced into the oven cavity 6 through a waveguide 13. An exhaustion duct 11 is provided above the oven cavity 6 for discharging the gas, moisture, etc. developed from the foodstuff 8. The gas sensor 12 is secured to the exhaustion duct 11 for detecting the concentration of the gas developed from the foodstuff 8. More specifically, as discussed in the U.S. Pat. No. 4,311,895, the resistance $R_s$ of the gas sensor 12 varies in response to the concentration of the gas developed from the foodstuff 8.

Figure 5:
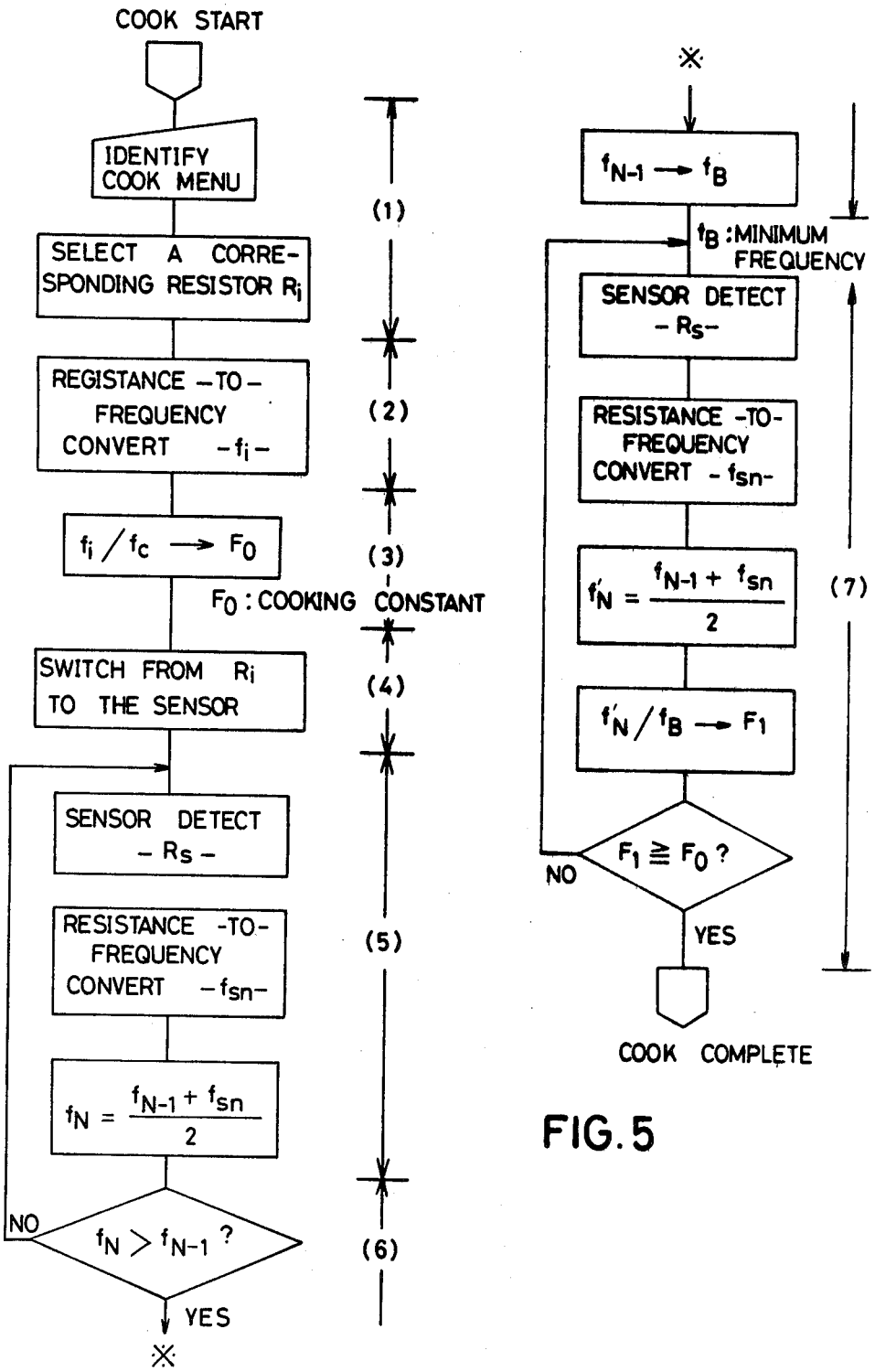
FIG. 5 is a flow chart for explaining an operation mode of the cooking operation control system of FIG. 2.

An operation mode of the microwave oven of FIGS. 2 and 4 will be described with reference to a flow chart of FIG. 5.

(1) The kind of foodstuff to be cooked is identified through the use of the keyboard panel (not shown). The selection control circuit 2 functions to select a resistor $R_i$ from the resistor group 14, the resistor $R_i$ corresponding to the kind of the foodstuff identified through the keyboard panel and determining the cooking constant suited for the foodstuff.

(2) The resistance-to-frequency converter 1 operates as an astable multivibrator including the charge/discharge circuit made of the selected resistor $R_i$, the resistor $R_B$ and the capacitor C. The capacitor C is charged from the power supply terminal through the resistors $R_i$ and $R_B$, and discharged through the resistor $R_B$ and, therefore, the timing of the charging and discharging operation is determined by the resistors $R_i$ and $R_B$ and the capacitor C. More specifically, the output frequency $f_i$ of the thus constructed astable multivibrator can be represented as the following equation (I).

$$f_i = K/(R_i + 2R_B) \cdot C \quad \text{(I)}$$

It will be clear from the equation (I) that the output frequency $f_i$ corresponds to the selected resistor $R_i$ which corresponds to the kind of foodstuff identified through the keyboard panel.

(3) The processor 3 functions to read in the oscillation frequency $f_i$ determined by the equation (I) from the resistance-to-frequency converter 1. The processor 3 calculates, through the use of the oscillation frequency $f_i$, the cooking constant which shows the completion point of the cooking operation, and the thus obtained cooking constant $F_0$ is memorized in the processor 3. More specifically, the cooking constant $F_0$ is determined in the following way as shown by an equation (II), wherein $f_c$ is a reference frequency obtained through experimentation.

$$F_0 = f_i / f_c \quad \text{(II)}$$

(4) Thereafter, the selection control circuit 2 switches off the resistor $R_i$, and switches on the terminal connected to the gas sensor 12. By this connection, the oscillation frequency of the astable multivibrator included in the resistance-to-frequency converter 1 is determined by the resistance value $R_s$ of the gas sensor 12.

(5) On the other hand, the foodstuff 8 is cooked in the oven cavity 6. In response to the cooking operation, gas is developed by the foodstuff 8 and functions to vary the resistance value $R_s$ of the gas sensor 12. Accordingly, the oscillation frequency of the resistance-to-frequency converter 1 varies in response to the cooking condition of the foodstuff 8. The varying output frequency is progressively read by the processor 3. As the output frequency varies in a manner $f_{s1}, f_{s2}, ---, f_{sn}$, the processor 3 conducts the following calculation, and stores a present frequency value $f_N$ obtained through the following equation (III), where $f_N$ is the estimated present value, $f_{N-1}$ is the last estimated value, and $f_{sn}$ is the present frequency data applied from the resistance-to-frequency converter 1.

$$f_N = (f_{N-1} + f_{sn})/2 \quad \text{(III)}$$

Figure 3:
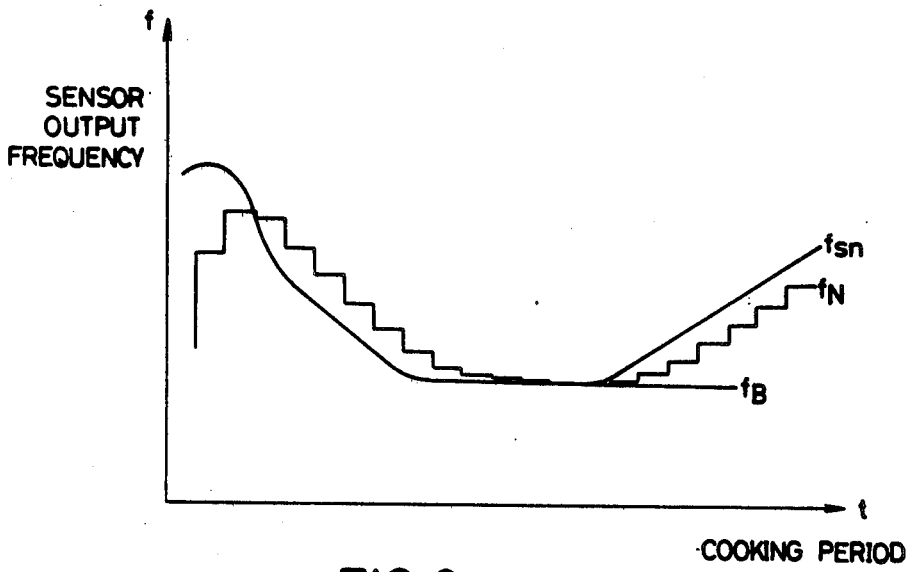
FIG. 3 is a graph showing variations of a sensor output frequency signal in the cooking operation control system of FIG. 2.

(6) The processor 3 compares the estimated present value $f_N$ with the last estimated value $f_{N-1}$. When the last estimated value $f_{N-1}$ is smaller than the estimated present value $f_N$, the processor 3 functions to store the last value $f_{N-1}$ as the lowest frequency $f_B$. When the last value $f_{N-1}$ is greater than or equal to the present value $f_N$, the operation is returned to the above-mentioned step (5) until the lowest frequency $f_B$ is obtained. FIG. 3 shows an example of the variation of the output frequency developed from the resistance-to-frequency converter 1 when the foodstuff 8 is cooked in the oven cavity 6. When the gas sensor 12 is employed for the sensor, the output frequency $f_{sn}$ ($f_N$) once takes the lowest value $f_B$ and gradually increases while the cooking operation is conducted.

(7) After obtaining the lowest frequency $f_B$, the output frequency of the resistance-to-frequency converter 1 is continuously read into the processor 3 in a manner as discussed in the step (5). The thus obtained frequency value $f'_N$ is divided by the lowest frequency $f_B$ to obtain a ratio $F_1$ ($=f'_N/f_B$) in the processor 3. The thus obtained ratio $F_1$ is compared with the cooking constant $F_0$ obtained in the step (3). When the ratio $F_1$ is smaller than the cooking constant $F_0$, the cooking operation is continuously conducted. When the ratio $F_1$ becomes greater than or equal to the cooking constant $F_0$, the processor 3 develops the control signal toward the drive control circuit 5 for terminating the operation of the cooking heat source 4.

Since the above-mentioned detection system has a time integrating effect, the detection accuracy is greatly isolated from noise. More specifically, the processor 3 detects the output frequency by counting the number of pulses appearing in a preselected period of time T. Even when the pulse noise is included in the output signal, the detection accuracy is not significantly influenced because the pulse noise is time integrated. Such pulse noise greatly influence detection accuracy in the conventional detection system, wherein the detection is based on the output voltage derived from the sensor element.

Further, the detection accuracy is not influenced by the distribution of the initial resistance value of the sensor element. This is because the resistance values of the cooking constant setting resistor and the sensor element are converted directly into the frequency signal and, hence, the initial resistance value can be cancelled out between the initial frequency and the detection frequency.

Moreover, the circuit construction can be simplified. This is because the main circuit is the calculation circuit and the comparator when the present resistance-to-frequency converting system is employed. Therefore, the control circuit can be implemented with a digital microcomputer system.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A cooking apparatus for cooking a foodstuff to a desired doneness comprising:

means for heating said foodstuff;

sensor means for monitoring a cooking condition and producing a variation in an output resistance value thereof;

means responsive to said sensor means for converting said resistance value of said sensor means into a sensor frequency indicative thereof;

means for compensating for variations in said sensor frequency produced by said means for converting by using the lowest sensor frequency monitored by said means for compensating to modify said sensor frequency to produce a compensated frequency signal substantially free of tolerance induced variations in the resistance of said sensor means;

reference means for developing a reference frequency signal representative of the desired doneness corresponding to a user selected menu;

control means for disabling said means for heating to terminate the cooking of said foodstuff upon coincidence of said compensated frequency signal developed from said means for compensating and said reference frequency signal developed by said reference means.

2. A cooking apparatus for cooking a foodstuff to a desired doneness comprising:

means for heating said foodstuff;

sensor means for monitoring a cooking condition and producing a variation in an output resistance value thereof;

means responsive to said sensor means for converting said the resistance value of said sensor means into a sensor frequency indicative thereof;

compensation means for monitoring said sensor frequency and dividing the current sensor frequency with the lowest monitored sensor frequency to produce a compensated frequency signal substantially free of tolerance induced variations in the resistance of said sensor means;

reference means for developing a reference frequency signal representative of the desired doneness corresponding to a user selected menu;

control means for disabling said means for heating to terminate the cooking of said foodstuff upon coincidence of said compensated frequency signal developed from said compensation means and said reference frequency signal developed by said reference means.

3. The cooking apparatus of claim 1 or 2 wherein said reference means comprises:

a resistor group including a plurality of resistors;

selection means for selecting a predetermined resistor included in said resistor group in response to user selected menu; and connection means for connecting said selected resistor to said converting means, thereby obtaining said signal of the reference frequency which is determined by said selected resistor.

4. The apparatus of claim 1 wherein said sensor means is a gas sensor with a resistance value which varies in response to the concentration of monitored gases generated from said foodstuff.

5. The apparatus of claim 2 wherein said sensor means is a gas sensor with a resistance value which varies in response to the concentration of monitored gases generated from said foodstuff.

6. The cooking apparatus of claim 3, which further comprises:

switching means for selectively connecting said selected resistor to said converting means to obtain said reference frequency signal, and for selectively connecting said sensor means to said converting means to obtain a signal representative of said sensor frequency.

7. The cooking apparatus of claim 6, wherein said converting means comprises:

an multivibrator; means and a discharge circuit means connected to said astable multivibrator wherein said switching functions to selectively connect said selected resistor or said sensor means to said charge/discharge circuit means for varying the oscillation frequency of said astable multivibrator means depending on the resistance value of said selected resistor or said sensor means.

8. The cooking apparatus of claim 1, 2, 4, or 5, wherein the resistance value of said gas sensor varies in response to the concentration of the gas generated from the foodstuff being cooked.

9. The cooking apparatus of claim 8, wherein said gas sensor varies the resistance value in response to the concentration of reducing gases which contact said gas sensor.

10. A method of cooking a foodstuff to a desired doneness comprising:

heating said foodstuff;

monitoring a cooking condition of said foodstuff by sensing the variation in a resistance value of a sensor;

converting said monitored resistance value into a sensor frequency indicative thereof;

determining the lowest monitored value of said sensor frequency;

compensating for variations in said sensor frequency by using said lowest monitored value to modify said sensor frequency to produce a compensated frequency signal substantially free of sensor resistance tolerance induced variations;

developing a reference frequency signal representative of the desired doneness in response to a selected menu;

comparing said compensated frequency signal to said reference frequency signal and terminating said step of heating upon coincidence thereof.

11. A method of cooking a foodstuff to a desired doneness comprising:

heating said foodstuff;

monitoring a cooking condition of said foodstuff by sensing the variation in a resistance value of a sensor;

converting said monitored resistance value into a sensor frequency indicative thereof;

monitoring said sensor frequency and dividing the present sensor frequency by the lowest monitored sensor frequency to produce a compensated frequency signal substantially free of sensor resistance tolerance induced variations;

developing a reference frequency signal representative of the desired doneness in response to a selected menu;

comprising said compensated frequency signal to said reference frequency signal and terminating said step of heating upon incidence thereof;

12. The method of claim 10 or 11 whereins said sensor monitors the concentration of the gas generated by said foodstuff.

* * * * *